US006872032B2

(12) United States Patent
Boys

(10) Patent No.: US 6,872,032 B2
(45) Date of Patent: Mar. 29, 2005

(54) RETAINING WALL BLOCK AND DRAINAGE SYSTEM

(75) Inventor: Mark A. Boys, Aromas, CA (US)

(73) Assignee: Soundstarts, Inc., Aromas, CA (US)

( * ) Notice: Subject to any disclaimer, the term of this patent is extended or adjusted under 35 U.S.C. 154(b) by 0 days.

(21) Appl. No.: 10/737,506

(22) Filed: Dec. 15, 2003

(65) Prior Publication Data

US 2004/0131430 A1 Jul. 8, 2004

Related U.S. Application Data

(63) Continuation of application No. 10/300,222, filed on Nov. 18, 2002, now Pat. No. 6,663,323.

(51) Int. Cl.[7] ..... E02D 17/20; E02D 29/02

(52) U.S. Cl. ..... 405/284; 405/36; 405/262; 52/606

(58) Field of Search ..... 405/36, 43, 45, 405/50, 262, 302.4, 302.7

(56) References Cited

U.S. PATENT DOCUMENTS 3,965,686 A * 6/1976 Saito et al. ..... 405/43
4,881,846 A * 11/1989 Burkstaller ..... 405/37
5,306,317 A * 4/1994 Yoshizaki ..... 47/1.01 R
5,567,077 A * 10/1996 Yang ..... 405/45
5,634,741 A * 6/1997 Tremblay et al. ..... 405/43
5,752,784 A * 5/1998 Motz et al. ..... 405/37
5,938,372 A * 8/1999 Lichfield ..... 405/38
6,312,190 B1 * 11/2001 Goughnour ..... 405/36
6,481,934 B1 * 11/2002 Alexiew ..... 405/302.7
6,691,472 B2 * 2/2004 Hubert ..... 52/169.5

* cited by examiner

*Primary Examiner*—Thomas B. Will
*Assistant Examiner*—Tara L. Mayo
(74) *Attorney, Agent, or Firm*—Donald R. Boys; Central Coast Patent Agency, Inc.

(57) ABSTRACT

A retaining-wall block has a set of liquid impervious walls defining a completely bounded cavity having a sealable opening for filling the cavity with a fill material to add weight, and a seal element for sealing the sealable opening. In some cases the block has a second cavity with openings for collecting liquid and for passing collected liquid out of the second cavity to adjacent blocks in an assembly.

1 Claim, 10 Drawing Sheets

RETAINING WALL BLOCK AND DRAINAGE SYSTEM

The present application is a continuation application of patent application Ser. No. 10/300,222 entitled "Retaining Wall Block and Drainage System", which was filed on Nov. 18, 2002, now U.S. Pat. No. 6,663,323 and which is incorporated herein in its entirety.

FIELD OF THE INVENTION

The present invention relates generally to block retaining walls, and pertains more particularly to wall blocks, systems for assembly, and drainage systems utilized for construction of such retaining walls.

BACKGROUND OF THE INVENTION

Many known systems and methods have been developed in the construction industry for forming block retaining walls constructed for such purposes as hillside erosion control, substantial ground elevation changes in landscaping, and so on. In conventional art such retaining walls are constructed with blocks usually formed of heavy, high-density material, typically concrete. In some applications the blocks may be formed of solid stone material cut from a base stone material.

A disadvantage common to conventional retaining wall blocks is that, due to the dense properties of the concrete or stone materials forming the block, a single conventional retaining wall block is a heavy object in itself, often 70–100 pounds or more for a commonly sized block, difficult for many to lift and handle conveniently. Another inherent disadvantage in such heavy blocks is that, since transportation costs of such materials is directly affected by the weight of the transported materials from the store outlet or manufacturing site of the new blocks to a final destination, transportation is often cost prohibitive, particularly when the work site is located in a substantially distant geographic location from the source of the heavy blocks.

Construction of most larger retaining walls, such as those designed for retaining hillsides, particularly ones which may, at times, have substantial water drainage needs, usually involves a substantial amount of ground excavation and preparation along and behind the proposed line of the wall, and then layering successive layers of back fill and drain fill materials, and often other supplemental drainage systems which may be required for proper drainage behind the retaining wall, along with successive rows of retaining wall blocks. A drainage pipe, or "tile" as it is commonly known in the industry, is commonly utilized for displacement of water which has drained down to the lower row of the retaining wall blocks, channeling the water draining into the drainage tile from above, along the base of the retaining wall, usually behind the retaining wall base layer, and eventually outside of the retaining wall area. In some extreme water situations such as when retaining walls are located near and below bodies of water or above-ground or below-ground streams, or in geographic areas with high annual rainfall, where sudden and intense rainfall may greatly increase the water saturation of the ground being retained in a short period of time, additional vertical drainage columns are employed to add increased drainage capability to the system.

Retaining wall block designs known in the art have addressed the problem of the heavy weight of individual concrete or stone building blocks by the development in the industry of lighter-weight, modular building blocks, some also adapted for receiving heavy fill material into a hollow cavity within the block. A block of this sort is taught in U.S. Pat. No. 5,658,098, issued to inventor Mark A. Woolbright on Aug. 19, 1997. The surface area behind a finished retaining wall utilizing such waterproof blocks forms a waterproof wall, through which water draining down from the ground and fill materials, and possibly accumulating behind the retaining wall, cannot pass. In some instances extreme drainage flow may cause water to drain through the soil and drain fill and backfill materials at a rate that is greater than that of the drainage capacity of the entire system, which may cause an elevated water level behind the retaining wall, particularly if the undisturbed soil behind the wall has been previously saturated. In such instances when drainage capacity is suddenly exceeded, the sudden excess water flow has nowhere else to accumulate but upward from the bottom of the retaining wall as the fill material fields continue to fill with drainage overflow water.

What is clearly needed is a retaining wall block and drainage system having the advantages of the individual block being of a substantially lighter weight compared to conventional concrete or stone retaining wall blocks, thereby greatly increasing the cost-effectiveness of transportation and handling of the blocks between the source and the work site, while also providing means for increasing the drainage capability of the retaining wall drainage system. Such an improved system also incorporates both additional drainage capacity into the individual building blocks, and additional drainage capacity for water draining through the drain fill and back fill materials behind the wall that when combined, provide far greater drainage capacity than systems of conventional art as described above. The individual, lightweight, drainage-capable building blocks of the system of the invention are adapted for receiving heavy fill material at the work site, causing each individual block to be of sufficient weight for construction of a retaining wall according to industry standards.

The additional drainage capability provided in such a retaining wall block and drainage system provides advantages over conventional systems by enabling one to economically increase the overall drainage capacity of the system so as to accommodate much greater fluctuations in drainage flow due to heavy rains, and so forth, thereby also greatly reducing the amount of ground excavation and preparation necessary prior to wall construction, because much shallower drain fill and free-draining back fill fields are required behind the retaining wall due to the increased drainage capacity incorporated into the blocks of the retaining wall. Such a system therefore greatly increases the cost-effectiveness of overall construction of the retaining wall and draining system, and also that of transporting and handling the retaining wall blocks and back fill and drain fill materials, by reducing the needed amount of such materials, which are typically provided from outside of the work site, and also by eliminating the need for various separate horizontal or vertical drain conduit systems which are required in many applications utilizing conventional retaining wall blocks.

The wall block and drainage system of the present invention addresses all of the above-described problems in the prior art by providing means for increasing drainage capacity in a retaining wall drainage system utilizing for the first time new and novel drain-capable lightweight retaining wall blocks and drainage systems in embodiments which are described below in enabling detail.

SUMMARY OF THE INVENTION

In a preferred embodiment of the present invention a retaining-wall block is provided, comprising a set of liquid impervious walls defining a completely bounded cavity having a sealable opening for filling the cavity with a fill material to add weight, and a seal element for sealing the sealable opening. In some embodiments the blocks are formed of polymer material by injection molding. It is known to the inventor that the blocks can be made of any other waterproof material. It is also known to the inventor that the blocks can be made of any non-waterproof material incorporating a waterproof insert. In some embodiments the block has a curved (or any other shaped) front simulating a stone material, concrete, wood or any other material. There may also be engagement elements for engaging adjacent blocks in an assembly to limit movement between the adjacent blocks.

In an alternative preferred embodiment the completely bounded cavity is a first cavity, and there is further a second cavity adjacent the first cavity, separated from the first cavity by at least one of the liquid-impervious walls, the second cavity having through-openings to the outside of the block for accepting drainage liquids, and for passing said liquids out of said second cavity into the blocks below or a drainage system.

In a preferred embodiment the block is formed of polymer material by injection molding. In an alternative embodiment the through-openings include openings on an upper surface to accept liquid from a second block above in an assembly of blocks, openings in a rearward-facing surface to accept liquid from a drain field, and openings in a lower surface for passing liquids to a third block below in an assembly of blocks. There may further be an engagement interface for engaging a drain grid comprising both a mesh material and conduits for liquid, wherein individual ones of the through-openings are positioned to engage individual ones of the conduits.

In some cases the through-openings include openings on an upper surface to accept liquid from a second block above in an assembly of blocks, openings in a rearward-facing surface to accept liquid from a drain field, at least one opening in a first side to accept liquid from an adjacent block in the assembly of blocks, and at least one opening in a second side opposite the first side to pass collected liquid to an adjacent block in the assembly.

In another aspect of the invention a retaining wall assembly of blocks is provided, comprising a plurality of individual hollow blocks, individual ones of said blocks comprising a set of liquid impervious walls defining a completely bounded cavity except for a fill opening and filled with a fill material to add weight. In preferred embodiments individual ones of the blocks in the assembly are formed of polymer material by injection molding. Also in preferred embodiments individual blocks have engagement elements used for engaging adjacent blocks in the assembly to limit movement between the adjacent blocks.

In an alternative preferred embodiment, in individual ones of the blocks, the completely bounded cavity is a first cavity, and there is further a second cavity adjacent the first cavity, separated from the first cavity by at least one of the liquid-impervious walls, the second cavity having through-openings to the outside of the block for accepting drainage liquids, and for passing said liquids out of said second cavity. In some embodiments the two-cavity blocks are formed of polymer material by injection molding. Also in some embodiments, in individual blocks, the through-openings include openings on an upper surface to accept liquid from a second block above in an assembly of blocks, openings in a rearward-facing surface to accept liquid from a drain field, and openings in a lower surface for passing liquids to a third block below in an assembly of blocks.

In some embodiments of the assembly, on individual ones of the blocks, there is an engagement interface for engaging a drain grid comprising both a mesh material and conduits for liquid, wherein individual ones of the through-openings are positioned to engage individual ones of the conduits. Also in some embodiments, in individual ones of the blocks, the through-openings include openings on an upper surface to accept liquid from a second block above in the assembly of blocks, openings in a rearward-facing surface to accept liquid from a drain field, at least one opening in a first side to accept liquid from an adjacent block in the assembly of blocks, and at least one opening in a second side opposite the first side to pass collected liquid to an adjacent block in the assembly.

In yet another aspect of the invention a drain grid for a retaining wall is provided, comprising a mesh material, and conduits for liquid, the conduits integrated with the mesh material. The drain grid is further characterized in that the conduits have openings for receiving liquid from surrounding volume.

In embodiments of the invention described in enabling detail below, for the first time blocks are provided for building retaining walls, wherein the blocks are of very light weight for transport, and can be made heavy at point-of-application, and wherein the weight cavities are fully enclosed. Such blocks may also have second cavities adapted for collecting and passing water.

BRIEF DESCRIPTION OF THE DRAWINGS FIGURES

DESCRIPTION OF THE PREFERRED EMBODIMENTS

Figure 1:
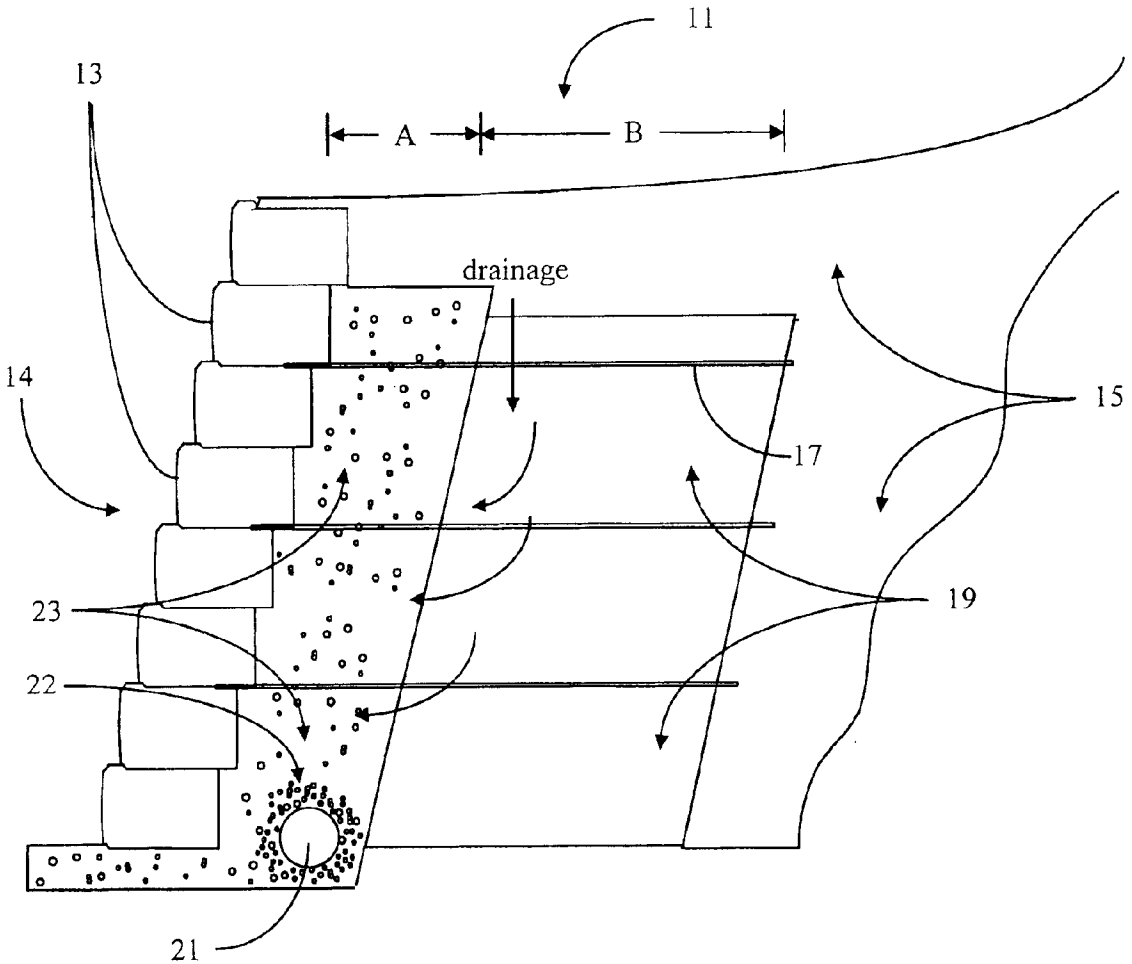
Fig. 1 (Prior Art)
FIG. 1 is a side elevation view of a retaining wall and drainage system according to conventional art.

FIG. 1 is a cutaway side elevation view of a retaining wall and drainage system 11 according to prior art. Retaining wall and drainage system 11 comprises a conventional retaining wall 14 formed by individual retaining wall blocks 13, drainage fill 23 and free-draining back fill 19, mesh anchoring material 17, and additional drainage and water disbursement provided by drain tile 21. Retaining wall 14 is constructed according to conventional methods well-known in the art for the purpose of retaining soil 15 undisturbed. Retaining wall blocks 13 forming retaining wall 14 are typically formed of high-density concrete or other solid stone material, as is most common in the industry, and are adapted to stack one upon the other such that retaining wall 14 is formed by arranging, side-by-side, a plurality of stacks of retaining wall blocks 13, which may also engage one another.

Blocks 13 represent conventional concrete or stone building blocks, which are provided in a wide choice of sizes, shapes and designs, and which may also be adapted for receiving various different designs of decorative facings, caps and so on. Blocks 13 are generally adapted to seat securely one upon the other utilizing various known means such as raised lip edges, such as shown in the present example, or may incorporate protrusions in one block to seat within sockets or notches in another block to secure one upper block from sliding on the top surface of a block below. The various means for preventing forward and backward movement of one block on another also typically allows for a setback angle to be achieved in the retaining wall, by securing an upper block to a lower block with the face surface of the upper block being slightly set back from flush with the face of the lower block, which is also shown in the example of FIG. 1.

Undisturbed soil 15 is shown in the prior art example of FIG. 1 to have an upward slope extending behind retaining wall 14. Undisturbed soil 15 also has a drainage requirement so as to avoid water accumulation behind retaining wall 14. Drainage back fill 19 and drainage fill 23 are typically employed as shown behind the retaining wall to provide such drainage, wherein some water draining from above or near the draining fill materials eventually drains through a portion of drainage fill 23 and is then channeled along the base of retaining wall 14 through drain tile 21, towards one end of the retaining wall, and eventually away from the retaining wall. Drain tile 21 is typically a tubular conduit which allows water to pass from above into the interior utilizing such as perforations, or the like, and runs parallel to the retaining wall, typically behind the retaining wall as shown in the example, having a slight descending grade as it continues to the discharge end of the conduit.

In most conventional applications the setback angle of the retaining wall such as wall 14 is determined, in part, by the desired finished height of the retaining wall. The angle is determined according to the slope and amount of pressure which will be placed above and behind the retaining wall by the undisturbed soil and drainage fill materials, as well as any additional surcharge or adverse soil conditions, and so on. In addition to the angle incorporated into retaining wall 14 such as shown in FIG. 1, retaining wall 14 is also typically anchored to the fill materials behind retaining wall 14 by utilizing sections of reinforced geogrid 17, used as previously described for conventional retaining wall systems in the background section. Geogrid 17 is typically a reinforced mesh material generally supplied in rolls of a predetermined width, and is cut to length according to the engineering pre-determination of the extent to which geogrid 17 is to extend into the fill material or soil behind wall 14. The number of layers and intervals at which the geogrid layers are placed is also determined by all of the previously described variables of wall height, soil conditions, drainage requirements, and so on. Water draining from undisturbed soil 15 and down through back fill 19 and drain fill 23 passes directly through the geogrid layers 17 embedded in the fill material, as the mesh material utilized in geogrid 17 is conventionally designed for such unimpeded water passage.

Dimensions A and B of FIG. 1 represent the depth of the fields of drain fill 23, and back fill 19, and combine also represent in the example the length of geogrid 17 extending behind retaining wall 14. Prior to construction of a retaining wall such as shown in FIG. 1, the combined dimensions of A and B also represent the minimal amount of excavation that must take place behind the proposed line of the retaining wall, in addition to that of the immediate area of the wall. For very high drainage requirements, such as in temperate geographic areas with heavy annual rainfall, or nearby bodies of water or small streams flowing aboveground or underground behind the retaining wall, and so on, the field depth of drain fill 23 and back fill 19 may be much deeper, requiring much more excavation and fill material than would be normally needed.

In the conventional example shown in FIG. 1, water drains from soil 15 into and through back fill 19 and drain fill 23, and through geogrid layers 17, down towards the bottom of retaining wall 14. If water drain flow is especially pronounced or prolonged, such as during or shortly after a sudden heavy rainfall, for example, the water seepage requiring drainage from behind retaining wall 14 may exceed the drainage capacity of the fill materials and lower soil 15, and the ability of drain tile 21 to carry the draining water away. In such an instance, particularly if the surrounding soil 15 is previously saturated prior to the increased drainage flow, the draining water will begin to accumulate in the fill material towards the bottom of retaining wall 14, and if the heavy drainage flows continue for a period of time at a rate exceeding the drainage capacity of the system, the water level will increase behind wall 14 as the fill and drainage materials continue to fill with drainage overflow, because the upwardly accumulating water overflow, which exceeds the drainage capacity of the system, has nowhere else to accumulate. The water is prevented from passing through the rear surface of retaining wall 14, due to the nature of the construction of the wall and individual blocks 13 utilized, and the surrounding soil 15 may be saturated and unable to absorb additional water. Undue pressure on retaining wall 14 and possible collapse of the system is the possible result in such an occurrence.

Figure 2B:
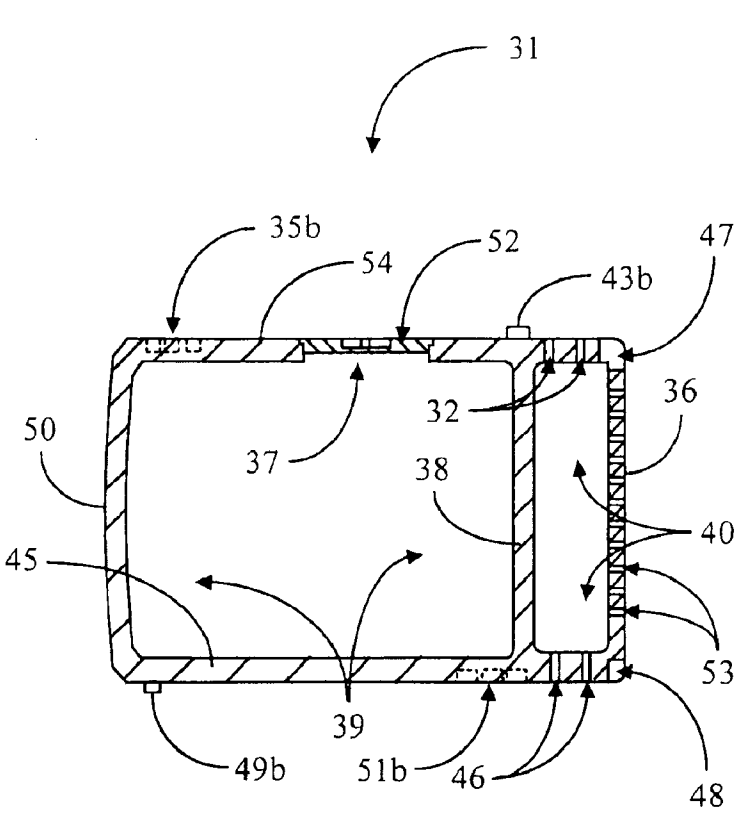
FIG. 2B is a section view of the retaining wall block of FIG. 2A, taken along section line 2B—2B.
Figure 2A:
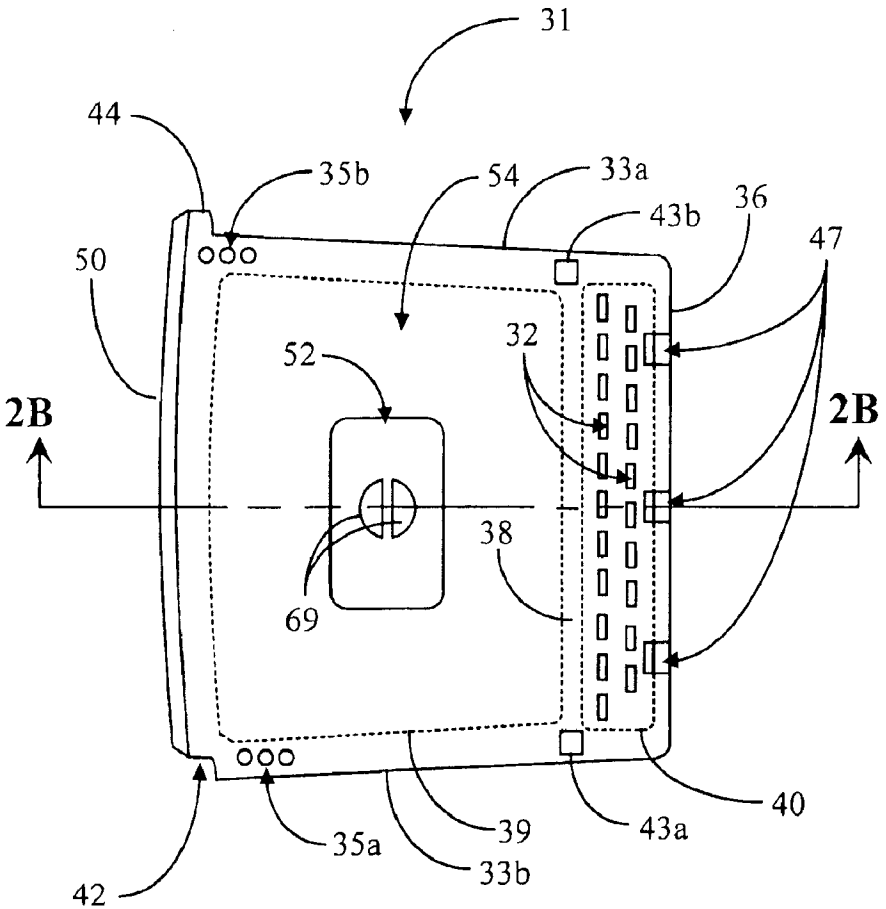
FIG. 2A is a top view of a retaining wall block according to an embodiment of the present invention.

Referring now to FIG. 2A and FIG. 2B, a new and novel retaining wall block 31 is presented according to an embodiment of the present invention, which block provides several advantages over conventional blocks. FIG. 2A is a top view of a retaining wall block 31 according to an embodiment of the present invention. FIG. 2B is a section view of retaining wall block 31 of FIG. 2A taken along section line 2B—2B of FIG. 2A. An exemplary representation of the embodiment is best given in the following description with reference to both FIG. 2A and 2B alternatively, and therefore is further described in such a manner.

Retaining wall block 31 it is preferably formed of high-density, extremely durable plasticized material, such as polyurethane or some other such polymer compound, which is lightweight, resistant to UV damage, erosion, impact, and is waterproof. The material used for forming block 31 is suitable for an injection molding process, which is the preferred method of manufacture for forming block 31. Other known methods, however, may be utilized in alternative embodiments for forming block 31. Block 31 can also be made of any other waterproof material or non-waterproof material with the incorporation a waterproof insert.

Another advantage of the innovative retaining block system is that the blocks can be made quite larger that the conventional retaining block whose size is restricted by shipping weight. An increased size would allow additional fill material to be added to the inside of the block thereby increasing the weight and effectiveness of the block. The fill material can be a combination of gravel and anti-freezing liquid.

Block 31 may be provided in a variety of shapes and sizes suitable for forming a retaining wall, and is shown in FIGS. 2A and 2B to be of a conventional height, width and depth commonly used in the industry. Referring again to FIGS. 2B and 2B, block 31 comprises a base 45, face wall 50, rear wall 36, side walls 33*a* and 33*b*, and a cap wall 54, all of which together define the shape and outside dimensions of block 31. Face wall 50 extends upwardly from base 45, and is better shown in FIG. 2A. Face wall 50 has a raised side lip 44 near the intersection of side wall 33*a*, and a groove 42 recess into the edge near the intersection of the opposite edge of face wall 50 and side wall 33*b*. Raised side lip 44 and groove recess 42 provide a means for aligning blocks 31 side-by-side such that a raised side lip 44 of a first block fits securely into a width recess 42 of a second adjacent block, thereby preventing forward movement of a side of the second block 31 against a side of a first block 31, and also obscuring from view any gap formed by space between the side walls of pair of adjacent blocks 31.

Referring again to FIG. 2A, the upper surface shown in the top view of cap wall 54 has a plurality of set back holes 35*a* and 35*b* near the intersection of face wall 50 and side walls 33*a* and 33*b*, aligned generally along the length of walls 33*a* and *b*. Individual ones of setback holes 35*a* and 35*b* are equally-spaced between adjacent holes in each set, and extend slightly into, but not completely through the thickness of cap wall 54.

As is better illustrated in FIG. 2B, block 31 also provides protrusions 49 extending slightly downward from the underside of base 45, located on base 45 relative to setback holes 35 on cap wall 54. Only one of protrusions 49, namely 49*b*, is shown in the sectional view of FIG. 2B, a second protrusion 49*a*, as will be shown in further illustrations, is hidden from view. Protrusions 49*a* and *b* and setback holes 35 of block 31 are for the purpose of engaging adjacent blocks and for preventing one block 31 stacked on top of another from sliding in any direction relative to the lower block. When stacking one block 31 on another, protrusions 49, which are slightly smaller in diameter than setback holes 35, seat snugly within setback holes 35, allowing the underside of base 45 of the upper block 31 to be generally flush and in substantial contact with the upper surface of the cap wall 54 of the lower block 31, the upper surface of lower block 31 thereby forming a smooth foundation for the upper block. An upper block 31 may be securely stacked on a lower block, the upper block slightly set back from the lower block by inserting protrusions 49*a* and 49*b* of the upper block into either the forward, middle or rearward sets of setback holes 35*a* and 35*b* when stacking one block upon another. The plurality of holes 35*a* and 35*b* thus provide a choice of position for stacking upper blocks on lower blocks. This choice of setback dimension allows a variation in the angle from vertical for a completed wall made from blocks 31. It will be apparent that the holes and protrusions need not be circular, but could be in any one of a variety of shapes.

Block 31 also has a pair of protrusions 43*a* and 43*b* in this embodiment located on either side of cap wall 54, located near the rear of cap wall 54, extending slightly upward from the upper surface, as better seen in FIG. 2B. Sets of holes 51*a* and 51*b*, each of which are slightly larger in depth and dimension than protrusions 43*a* and 43*b* of cap wall 54, are located on the underside of block 31, also towards the rear, and extend partially into the thickness of base 45. Recessions 51*a* and 51*b* are arranged linearly, similar to the arrangement for setback holes 35 of cap wall 54, and the distance between the centers of each recession 51*a* or *b* to that of adjacent recession 51*a* or *b* is the same distance as the center of one setback hole 35 to the center of an adjacent setback hole 35. Although only one set of recessions are shown in the sectional view of FIG. 2A, namely recessions 51*b*, an additional and identical set of recessions 51*a* are present in block 31, located on the opposite side of block 31 from recessions 51*b* shown, but are not shown in FIG. 2B. Protrusions 54*a* and 54*b* and recessions 51*a* and 51*b* have the purpose of securing a portion of anchoring mesh material to blocks 31 in a retaining wall, as will be detailed further below.

It will be apparent that setback holes and protrusions, raised lip extensions and recesses, and the like, for securing one block on top of or next to another, and for securing a portion of anchoring mesh material, such as described above in the embodiment presented in FIGS. 2A and 2B, are known and commonly utilized in the art, and a variety of different interlocking and mesh-securing apparatus and methods may be utilized in systems in which the present invention may be practiced, without departing from the scope and spirit of the invention.

Side walls 33*a* and 33*b* extend upright from base 45 on either side of, and behind face wall 50. Rear wall 36 extends upwardly from the rear edge of base 45, each side edge of rear wall 36 meeting a side edge of a side wall 33*a* or 33*b*. Rear wall 36 has a slightly smaller width dimension than that of face wall 50, such that blocks 31 arranged side-by-side may be slightly angled so that outside curves in the retaining wall may be achieved without affecting the appearance of the front seam between face walls of individual blocks 31. Cap wall 54, generally equal in width and length to base 45, covers the upper edges of face wall 50, side walls 33 and rear wall 36 to form an enclosure.

The height of building block 31 is defined by distance between the outside bottom surface of base 45 and the outside upper surface of cap wall 54, and the width dimension of block 31 is defined by the distance between the outer surfaces of side walls 33*a* and 33*b*, and the length dimension of block 31 is defined by the distance between the outer surface of face wall 50 and that of wall 36. In alternative embodiments different from that shown in FIG. 1 face wall 50 may be of different height or width than that of the outer dimensions of block 31 itself, for decorative purposes, or for providing overlap for seams between blocks, and so on.

Referring again to FIG. 2B, block 31 comprises a unique cavity wall 38 which also extends upwardly from base 45 parallel to, and in between the inner surfaces of face wall 50 and rear wall 36, positioned substantially rearward to the center of the length dimension of block 31, such that, in this embodiment, two separate cavities 39 and 40 are formed within the enclosure of block 31, the rearward smaller cavity 40, in a preferred embodiment, being of substantially smaller volume than the forward cavity 39.

Cavities 39 and 40 are formed by cavity wall 38 between face wall 50 and rear wall 36. Cavities 39 and 40 are shown by hidden lines (dotted) in FIG. 2A, and are more clearly illustrated in the sectional view of FIG. 2B. The volume of cavity 39 is defined by the distance between the inner surfaces of face wall 50 and the opposing surface of cavity wall 38, the inner surfaces of side walls 35 and the upper surface of base 45 and bottom surface of cap wall 54. The volume of cavity 40 is defined by the distance between the inner surfaces of rear wall 36 and the opposing inner surface of cavity wall 38, the inner surfaces of side walls 35 and the upper surface of base 45 and bottom surface of cap wall 54. Cavity 40 is separate from cavity 39, in that fluid or fill material cannot pass between one cavity and the other.

The purpose of the larger cavity 39 is for receiving fill material, such as water or other fluid, or other heavy fill materials which may include water, such as a water/gravel mixture, in geographic areas where freezing is not an issue, for example, or a mixture of anti-freeze solution and water, or a combination of any of the above. Ideally, all or a large portion of the fill material for filling cavity 39 of block 31 is obtained from the construction site during construction of the retaining wall, in the case of using earth or gravel or fill material, or, in the case of water or liquid mixture fill, may be delivered to the construction site by such means as pumping the fill material through a delivery hose to blocks 31 and filling blocks 31 as each is positioned during retaining wall construction, by pumping the fill from a local source or from an onsite container delivered to the construction site, for example.

Fill cavity 39 in an embodiment of the invention has a fill volume preferably of 80 percent or more of the total volume of cavities 39 and 40 within block 31, which is deemed by the inventor to be more than sufficient for containing an amount of fill material which would allow block 31, upon filling cavity 39 to capacity with whatever fill material described above is used, to have sufficient weight for a retaining wall block. Block 31, being formed primarily of polymeric material or other similar high-density material, is relatively lightweight in its unfilled state, allowing for ease of lifting and transporting, but also has sufficient weight in its filled state to provide necessary stability to act as a module for a retaining wall constructed according to industry standards.

Face wall 50, rear wall 36, side walls 33*a* and 33*b*, base 45 and cap wall 54 in the embodiment shown each have a mean thickness sufficient for providing support and stability for block 31 in an unfilled condition so as to minimize damage during transportation of blocks 31 to the construction site, while also allowing for sufficient volume in cavity 39 for containing an amount of fill material sufficient for block 31 to achieve desired weight when filled. Structural integrity of block 31 sufficient for enabling block 31 to be used as a module in a retaining wall is provided by the fact of the mean thickness of all of the walls of block 31 as mentioned above, combined with that of the fill volume itself within cavity 39.

Block 31 is provided with an opening 37 extending through cap wall 54 allowing access to cavity 39 for the purpose of filling cavity 39 with filling material. A fill cap 52 is provided adapted to tightly seal opening 37, such that the upper surface of fill cap 52 is flush with or recessed from the upper surface of cap wall 54, when fill cap 52 is inserted into opening 37, as is clearly shown in FIG. 2B. Fill cap 52 provides a water-tight seal preventing water or fill material within block 31, or outside materials surrounding block 31 in a construction wall, from passing through opening 37. In this embodiment recesses 69, being a pair of half-circle indications extending slightly into the surface of fill cap 52, are provided to allow for a person to easily remove fill cap 52 by grasping the cap vie recesses 69 with the fingers and removing fill cap 52 up from opening 37. In other embodiments the opening may be circular and threaded, and cap 52 may be circular with a matching thread, so the opening is sealed by rotating the cap into the opening in the manner of a pipe plug.

Cavity 40 provides block 31 with a drainage capability which is integrated into the design of block 31. Drain cavity 40 is separate from fill cavity 39, thereby preventing fill material from escaping cavity 39 into cavity 40, or any drainage material from entering fill cavity 39 from drainage cavity 40. As is further described below in subsequent illustrations and description, block 31, utilizing drain cavity 40, is adapted for draining water into and out of cavity 40 from above block 31, and also from behind block 31 through rear wall 36.

FIG. 2A illustrates a plurality of drain holes 32 arranged near the rear of block 31 towards rear wall 36. Drain holes 32 extend completely through the thickness of cap wall 54, and open into drain cavity 40, shown directly below in the hidden view. Drain holes 32 have a purpose of allowing water to drain from directly above drain holes 32 down into drain cavity 40. An arrangement of drain holes 46, similar to drain holes 32, extend completely through base 45 at the bottom of cavity 40, better illustrated in FIG. 2B. Drain holes 46 have the purpose of allowing water to drain from cavity 40 down through drain holes 46 and out directly below cavity 40. A plurality of drain holes 53 is also provided to allow additional drainage capability through rear wall 36 into drain cavity 40. Drain holes 53 extend completely through the thickness of rear wall 36, as better seen in FIG. 2B, and enable water to drain from behind block 31, through rear wall 36, into drain cavity 40.

Also shown are a plurality of passages 47 extending into and completely through rear wall 36. Passages 47 are half-circular in shape in this embodiment, and are located at the intersection of the upper edge of rear wall 36, and rearward edge of cap wall 54, better illustrated in FIG. 2B. Passages 47 open into cavity 40 as shown in FIG. 2B, and also provide additional drainage capacity into drain cavity 40, when utilized with an additional drainage grid system as will be shown in further illustrations and description.

Recesses 48 are shown in FIG. 2B extending into rear wall 36, but not completely through rear wall 36, as do passages 47. Recesses 48 are of the same shape and size as passages 47, and are located at the intersection of the lower edge of rear wall 36 and the rear edge of base 45, relative to the locations of passages 47 along the upper edge of rear wall 36. The relevance of the locations of passages 47 and recessions 48 relative to each other is also made clear in subsequent illustrations and description.

Figure 2D:
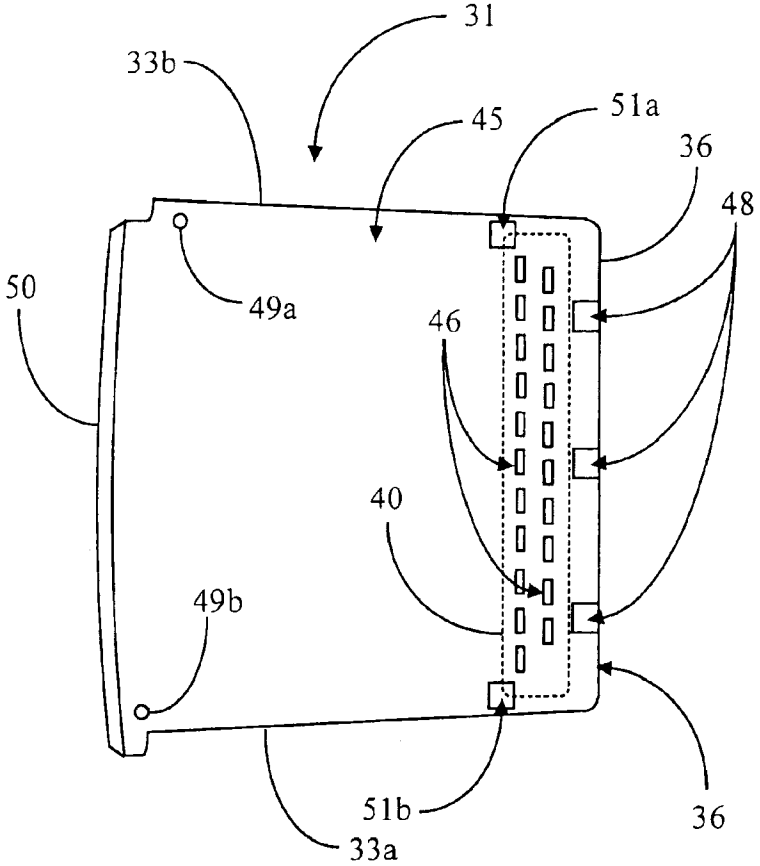
FIG. 2D is a bottom view of the retaining wall block of FIG. 2A.
Figure 2C:
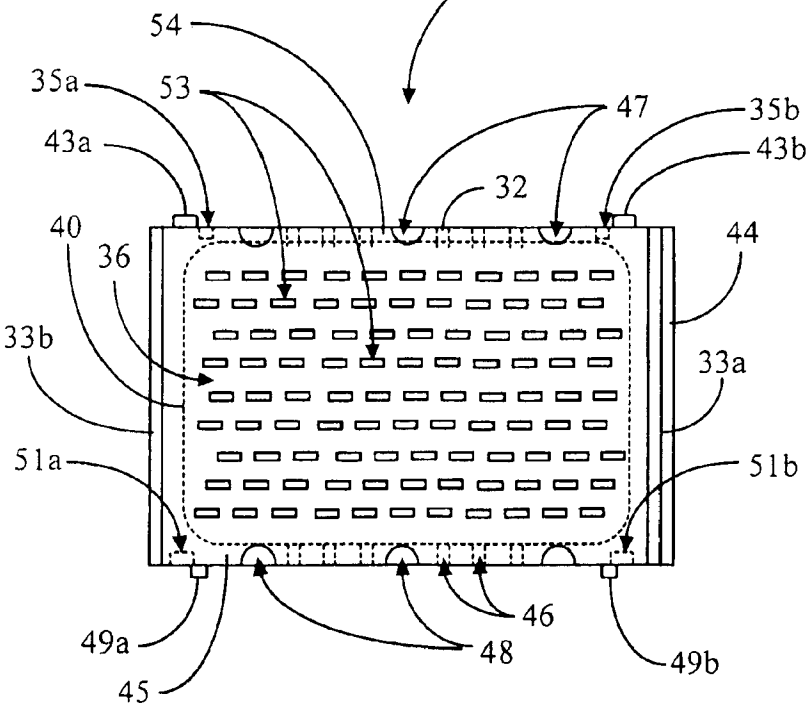
FIG. 2C is a rear view of the retaining wall block of FIG. 2A.

FIG. 2C is a rear view of retaining wall block 31 of FIG. 2A. A face-on view of the outer surface of rear wall 36 is provided, clearly illustrating the plurality of drain holes 53 described above which extend completely through to internal drain cavity 40. Drain passages 47 are also clearly shown along the upper edge of rear wall 36, passages 47 also passing completely through rear wall 36 into drain cavity 40. Recesses 48 are shown in their location along the lower edge of rear wall 36, relative to the location of drain passages 47 along the upper edge of rear wall 36, being of similar size and dimensions as drain passages 47. Protrusions 43*a*, and 43*b*, extending upward from cap wall 54 near side walls 33, are also clearly seen in this view, and recessions 51*a* and 51*b* are shown extending slightly into the underside of base 45, recessions 51 located relative to the location of protrusions 43 of cap wall 54. Protrusions 49*a* and 49*b* are also shown in this view extending slightly down from the underside of base 45 near side walls 33, and setback holes 35, located in cap wall 54 relative to the location of protrusions 49, are shown extending slightly down into the surface of cap wall 54.

Drain holes 32 are shown extending completely through cap wall 54, providing drainage from above block 31 into drain cavity 40, and drain holes 46 are shown extending completely through base 45 providing drainage from within drain cavity 40, through base 45 and out the underside of base 45. Drain holes 53 are shown in this view substantially covering the area of rear wall 36, providing a substantial increase in drainage capability from behind block 31, drain holes 53 passing completely through rear wall 36 into drain cavity 40.

FIG. 2D is a bottom view of the retaining wall block of FIG. 2A. A face-on view of the bottom surface of base 45 is given in the illustration, clearly showing the location of protrusions 49*a* and 49*b*, near the intersections of the side edges of face wall 50 and side walls 33, as well as the location of recessions 51*a* and 51*b* near the intersections base 45 and rearward edges of side walls 33. Recessions 48 can also be clearly seen along the rear edge of base 45, recessions 48 extending partially into the intersection of rear wall 36 and base 45. Drain holes 46, which extend completely through base 45, as shown in FIG. 2C, are arranged towards the rear of base 45, relative to the internal drain cavity 40, such that the entire plurality of drain holes 46 open into drain cavity 40, allowing water to drain directly below and out from drain cavity 40 unimpeded.

As described in the background section and portions of the description relative to the conventional example of the retaining wall and drainage system 11 of FIG. 1, in addition to the angle incorporated into a retaining wall for added stability for restraining the soil and drain fill material behind the retaining wall, the retaining wall is also anchored to the drain fill materials and soil behind the retaining wall by utilizing sections of reinforced mesh material, known in the industry has geogrid, as previously described for conventional retaining wall systems. The number of layers and intervals at which the geogrid layers are placed is also determined by all of the previously described factors of wall height, soil conditions, drainage requirements, and so on.

Individual retaining blocks 31 in some embodiments of the present invention also utilize such an anchoring system, except that the mesh anchoring system of the present invention also uniquely incorporates additional drainage capability into the anchoring mesh system, thereby providing a distinct advantage over conventional systems which do not incorporate such additional drainage capability, which is described below in enabling detail.

Figure 3A:
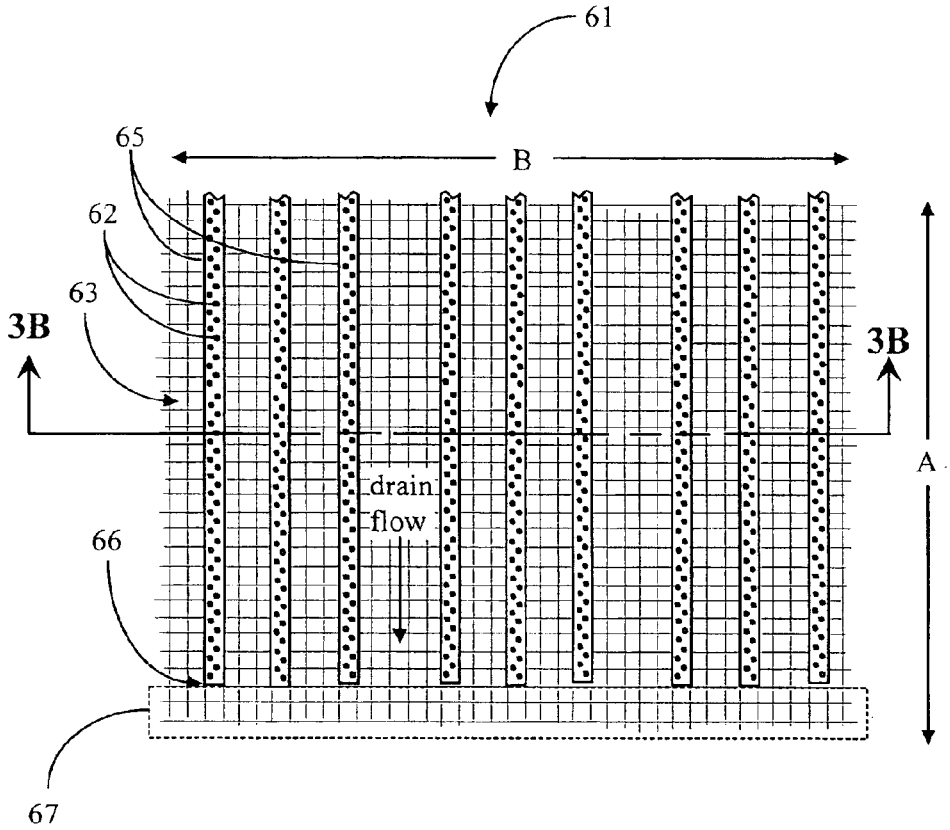
FIG. 3A is a top view of a section of drain grid according to an embodiment of the present invention.

FIG. 3A is a top view of a section of drain grid 61 according to an embodiment of the present invention. Drain grid 61 comprises a reinforced mesh 63, similar to that of geogrid material commonly known in the industry, modified with a plurality of drain channels 65 which are integrated with the mesh material for providing substantial additional water drainage and disbursement per cubic yard of drain fill and back fill behind a retaining wall, as compared to conventional systems utilizing conventional geogrid material.

Each drain channel 65 in the embodiment shown is essentially a tubular water disbursement conduit, having perforations 62 along substantially the entire length of drain channel 65, extending completely through at least an upper portion of each drain channel 65, so as to allow water to drain freely from directly above and around the area of drain channel 65, into the interior of drain channel 65, and then to be channeled by drain channel 65 away from the points of entry, towards output ends 66. Perforations 62 are adapted and designed to keep solid material in and allow only liquid in. Perforations can be of any shape. Drain grid 61 is designed to allow unfettered water passage through mesh 63, while mesh 63 also firmly anchors the retaining wall utilizing blocks 31 to the drain fill and back fill material behind the retaining wall, as in conventional geogrid mesh materials. In an alternative embodiment (not shown) drain conduits 65 may be glued into pre-formed holes into the rear of block 31 to provide additional anchoring characteristics for the grid material to block connection.

Near output ends 66 of drain channels 65, is a header portion 67 of mesh 63, allowing enough mesh 63 material to extend beyond output ends 66 of drain channels 65, to allow for attaching drain grid 61 by header portion 67 between two stacked rows of reinforcing wall blocks 31 of FIG. 2A, as is described further below. The length of a section of drain grid 61 is represented by dimension A, and the width by dimension B, as shown in FIG. 3A. Drain grid 61 is preferably provided in a number of pre-cut lengths differing in length in increments according to lengths typically used in the industry for common applications, considering various slopes, soil conditions, additional surcharges and water drainage requirements behind the retaining wall, as described in the background section. In such a manner, if the engineering analysis of the conditions behind a retaining wall necessitate a length of drain grid somewhat different than the pre-cut length as provided, drain grid 61 may be trimmed to the exact desired length at the end opposite of mesh header portion 67, with minimal scrap. Also, drain grid 61 may be rolled up along its length, and supplied to the construction site in a length equaling the proposed length of the retaining wall, or may be unrolled over a layer of previously laid down retaining wall blocks and compacted material during construction of the retaining wall, and then trimmed to size at the end of the layer, by cutting along the length of mesh 63 of drain grid 61.

In alternative embodiments of the present invention, drain channels 65 may be provided for drain grid 61 which may be collapsible channels woven into mesh 63, with a collapsible perforated top portion allowing drainage into the collapsible channel, such that when drain grid 61 is rolled up, drain channels 65 collapse to provide compactness of storage, and then upon installation, a collapsible drain grid 61 may secured down by the starting end at a starting point of the retaining wall layer, unrolled along the entire length of the retaining wall layer, and then cut flush with the ending point of the retaining wall. Drain grid 61 may then be anchored to a row of retaining wall blocks 31 utilizing mesh header portion 67, extended back from the row of retaining blocks, and then secured into position by tacking the end of drain grid 61 opposite mesh header portion 67 into the ground behind the retaining wall. Upon stretching drain grid 61 and applying slight tension before securing into the ground, the collapsible drain channels 65 would also stretch out and form drain channels capable of carrying drain water away from the drainage area, and the passages within drain channel 65 would remain open when the next layer of drain fill material is layered upon it.

Figure 3B:
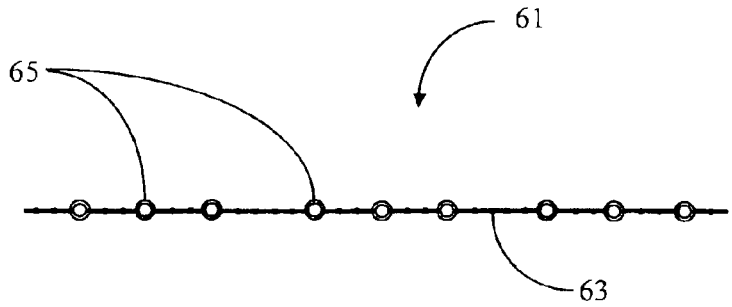
FIG. 3B is a section view of the drain grid of FIG. 3A taken along section line 3B—3B.

FIG. 3B is a section view of drain grid 61 of FIG. 3A taken along section line 3B—3B of FIG. 3A. Drain channels 65 are shown in the illustration to be of a tubular shape, but it is noted that whether drain channels 65 are round or some other shape is not particularly important in practicing the present invention, as long as drain channels 65 allow drain water to drain along the length of drain channel 65. In the embodiment shown, drain channels 65 are integrated into mesh 63, and arranged in three groups of three, and are spaced from each other within each group when drain grid 61 is laid flat as shown in FIG. 3B, such that when the portion of drain grid 61 shown, is stretched across and attached to a row of three retaining wall blocks 31 of FIG. 2A, each output end 66 of drain channels 65 is aligned with each passage 47 of the three retaining wall blocks 31. The distance between the center points of one drain channel 65 and that that of an adjacent drain channel 65 within the same group of three, is the same as the distance between the center points of one of passages 47, and that of an adjacent passage 47 in a retaining wall block 31. The relevance of the spacing between drain channels 65 of drain grid 61, and that of passages 47 of retaining wall block 31, is made readily apparent in description below.

Figure 4A:
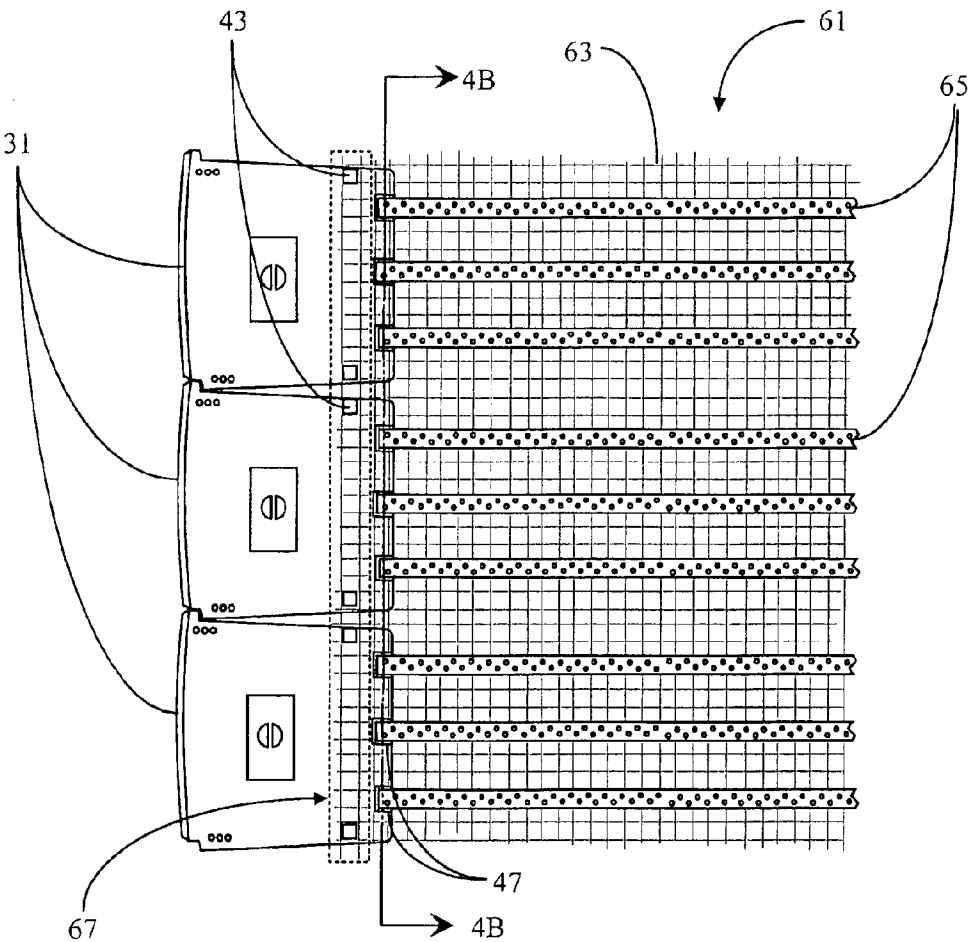
FIG. 4A is a top view of a section of the drain grid of FIG. 3A secured to retaining wall blocks of FIG. 2A according to an embodiment of the present invention.

FIG. 4A is a top view of a section of drain grid 61 of FIG. 3A secured to adjacent and joined retaining wall blocks 31 according to an embodiment of the present invention. FIG. 4A illustrates a manner in which drain grid 61 is laid over and attached to upper surfaces above a row of three retaining wall blocks 31. In practice, there will typically be many more retaining wall blocks 31 arranged in their installed position than are shown in FIG. 4A, and only a portion of drain grid 61, generally equal in width to the combined width of the three blocks 31, is shown for simplicity. The purpose of FIG. 4A is to illustrate attaching drain grid 61 to a plurality of retaining wall blocks 31.

In this example retaining wall blocks 31 have been placed in their proper position during construction of a retaining wall, and may be assumed to be securely resting upon a layer of retaining wall blocks below, acting as a foundation, or on another foundation surface. Header portion 67 of mesh 63 is positioned over the rearward portion of the row of blocks 31, such that each of the output ends 66 of drain channels 65 are positioned near passages 47 of blocks 31. Output ends 66 of drain channels 65 are then seated within passages 47 as far forward as they will fit, and mesh header portion 67 is then stretched over protrusions 43, which extend slightly upward from the top surface of blocks 31, and a single opening of mesh 63 is then pulled over each of protrusions 43, protrusions 43 being slightly less in dimensions than each opening of mesh 63, thereby securing mesh 63 by header portion 67 to the row of blocks 31, which also holds the output ends of each drain channel 65 of drain grid 61 into each passage 47 of blocks 31.

Although it is not explicitly shown in FIG. 4A, it can be assumed that retaining wall blocks 31 have been positioned and a layer of drain fill and back fill has also been applied behind the row of blocks 31 and compacted such that the upper level of the drain and back fill material is generally flush with the upper surface of blocks 31, in accordance with construction of a retaining wall utilizing known methods. Drain grid 61 is attached to the row of retaining wall blocks 31, as shown, and is then laid out over the drain and back fill materials behind blocks 31, such that a slight downward grade toward blocks 31 is incorporated along the length of drain grid 61, so that drain channels 65 follow a gentle slope downward towards retaining wall blocks 31. In such a manner, water draining into drain channels 65 flows, urged by gravity, towards blocks 31, and then enters blocks 31, into the internal drainage cavities 40 (not shown), as previously described, through passages 47 of blocks 31. Header portion 67 of mesh 63 is sufficiently flexible such that if a light curvature is desired in the retaining wall, individual blocks 31 may be slightly angled to accommodate such a curvature, without affecting the attachment of header portion 67 to protrusions 43 of blocks 31, and securing of output ends 66 of drain channels 65 into passages 47 of blocks 31.

Figure 4B:
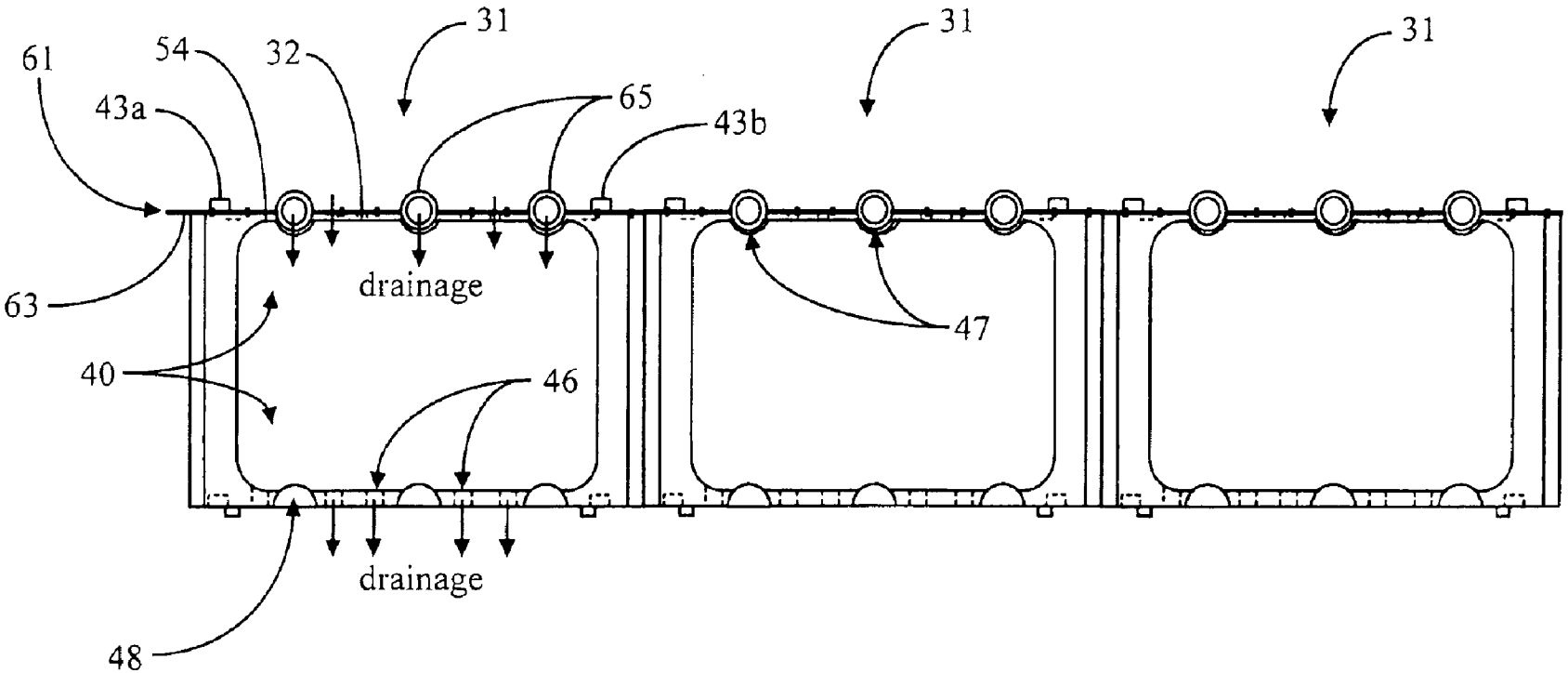
FIG. 4B is a section view of the drain grid and retaining wall blocks of FIG. 4A, taken along section line 4B—4B of FIG. 4A.

FIG. 4B is a section view of drain grid 61 and retaining wall blocks 31 of FIG. 4A, taken along section line C—C. In this view, three blocks 31 are arranged in their installed position, as in FIG. 4B. Drain grid 61 is layered directly atop the upper surfaces of blocks 31, and attached at the header portion 67 to blocks 31 as illustrated in the previous figure. Protrusions 43 can be seen protruding up from the upper surfaces of blocks 31, and extending up through mesh 63 of drain grid 61, as previously described. Drain channels 65 of drain grid 61 are now clearly shown seated into passages 47, each of which open into drain cavity 40. Recessions 48 are shown along the bottom of each block 31, positioned relative to passages 47 along the top of block 31.

A plurality of drain holes 32 are shown extending completely through cap wall 54 of blocks 31 and opening into drain cavity 40, and a plurality of drain holes 46 are also shown extending completely through base 45, also with an opening into drain cavity 40, as described previously. As described earlier, drainage water is allowed to drain into drain cavity 40 from drain holes 32 extending through cap wall 54, as well as passages 47 from the output ends a drain channels 65, and then is allowed to drain out of drain cavity 40 down through drain holes 46 extending through base 45. In practice, if drain flow from drain channels 65 of drain grid 61, and that of drain holes 32 through cap wall 54, momentarily exceeds the drainage capacity of drain holes 46, the volume of drain cavity 40 may provide reservoir volume for any required accumulation of drain water until the incoming drain flow recedes to a point equal to or less than the capacity of drain holes 46.

Figure 5B:
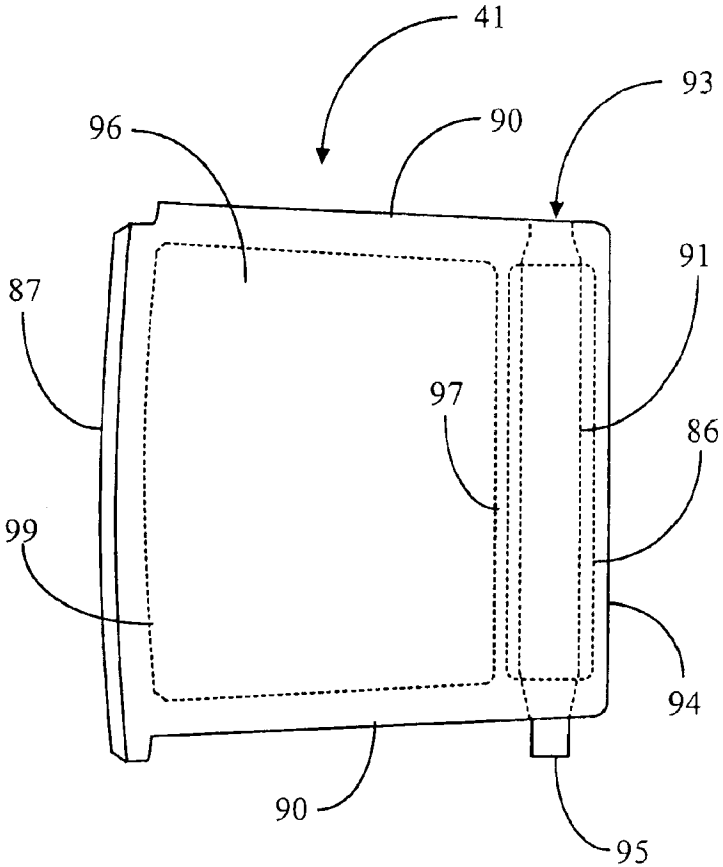
FIG. 5B is a bottom view of the retaining wall block of FIG. 5A.
Figure 5A:
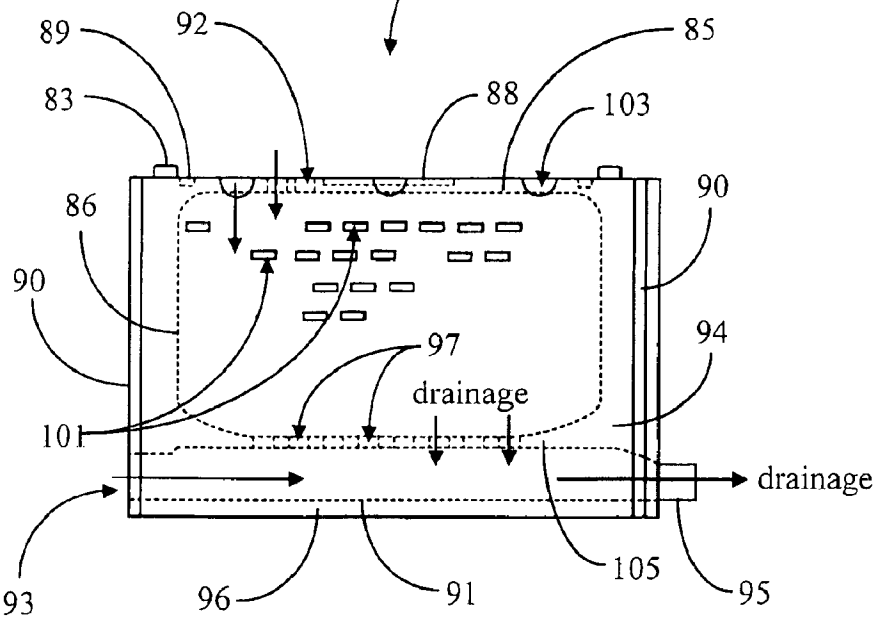
FIG. 5A is a rear view of a bottom-row retaining wall block according to an embodiment of the present invention.

A bottom-row retaining wall block, used in conjunction with blocks 31 and drain grid 61 is illustrated in FIGS. 5A and 5B. FIG. 5A is a rear view of a bottom-row retaining wall block 41 according to an embodiment of the present invention. FIG. 5B is a bottom view of retaining wall block 41 of FIG. 5A. Drain block 41 is a polymeric retaining wall block adapted for filling a cavity within block 41 with fill material, and has drainage capability integrated within block 41 allowing for drainage to enter block 41 similarly to the drainage capability as illustrated for block 31 previously described. Referring now to FIGS. 5A and 5B, drain block 41 comprises a face wall 87, a pair of side walls 90, a base 96, a cap wall 85 and a rear wall 94, which combine to form an enclosure, generally equal in outside dimensions and shape to those of block 31 of FIG. 2A. Block 41 also has an internal cavity wall 97, similar to that of block 31, situated between face wall 87 and rear wall 94, forming a pair of separate internal cavities in block 41, cavity 99 being the larger of the two, for filling with fill material similar to fill cavity 39 of block 31, and a smaller cavity 86 located to their rear of fill cavity 99, which accommodates drainage into block 41, also similarly to block 31. Water is enabled to drain into drain cavity 86 through drain holes 92 extending completely through cap wall 85, equivalent to drain holes 46 of block 31, and passages 103, which are equivalent to passages 47 of block 31, also opening into drain cavity 86. Also similar to block 31, as shown in their rear view of FIG. 5A, a plurality of drain holes 101, equivalent to drain holes 53 of rear wall 36 of block 31, allow additional drainage from the area behind rear wall 94 of drain block 41, through rear wall 94 into drain cavity 86. It is noted, however, that base 96 of block 41, differs from base 45 of block 31, in that there are no protrusions extending from, or recessions extending into base 96, as used in block 31 for aligning and securing an upper block 31 to a lower block 31, because block 41 is designed to be the bottom-row block in practice of the present invention. Notably, block 41 also lacks drainage holes extending through base 96, such as drainage holes 46 of block 31, because there is intended to be no drainage from drain cavity 86 through base 96.

Block 41 also has a pair of protrusions 83 for attaching a header portion 67 of a drain grid 61, and a set of setback holes 89, equivalent to set back holes 35 of block 31, extending partially into the upper surface both cap wall 85, for inserting protrusions 49 of a block 31, which is stacked atop block 41 in practice of the invention, as detailed further below.

Bottom-row retaining wall block 41 differs significantly from retaining wall block 31, in that a drainage base wall 105 is provided between cap wall 85 and base 96, and a drainage conduit 91 is provided below base wall 105 for channeling drainage water away from block 41. Drainage conduit 91 is positioned directly below drain cavity 86, and extends along the width of block 41 from the outer surface of one side wall 90 to the outer surface of the opposite side wall 90. Drain conduit 91 has an intake opening 93 on one end, and an output nozzle 95 on the other end, intake opening 93 having an inside diameter slightly greater than the outside diameter of output nozzle 95. Output nozzle 95 is adapted to fit neatly and snugly into intake opening 93.

Drain holes 97 are provided to allow drainage from drain cavity 86 into drain conduit 91, drain holes 97 passing completely through drain wall 105 into drain conduit 91. Drainage water enters block 41 through drain holes 92 of cap wall 85, drain passages 103, and drain holes 101 of rear 94, in the same fashion that water enters block 31 as previously described. However, instead of drain water exiting block 41 through base 96, similarly to that of block 31, drain water exits drain cavity 86 down through drainage holes 97, into drain conduit 91, and then is channeled out of block 41 via drain conduit 91.

Figure 6:
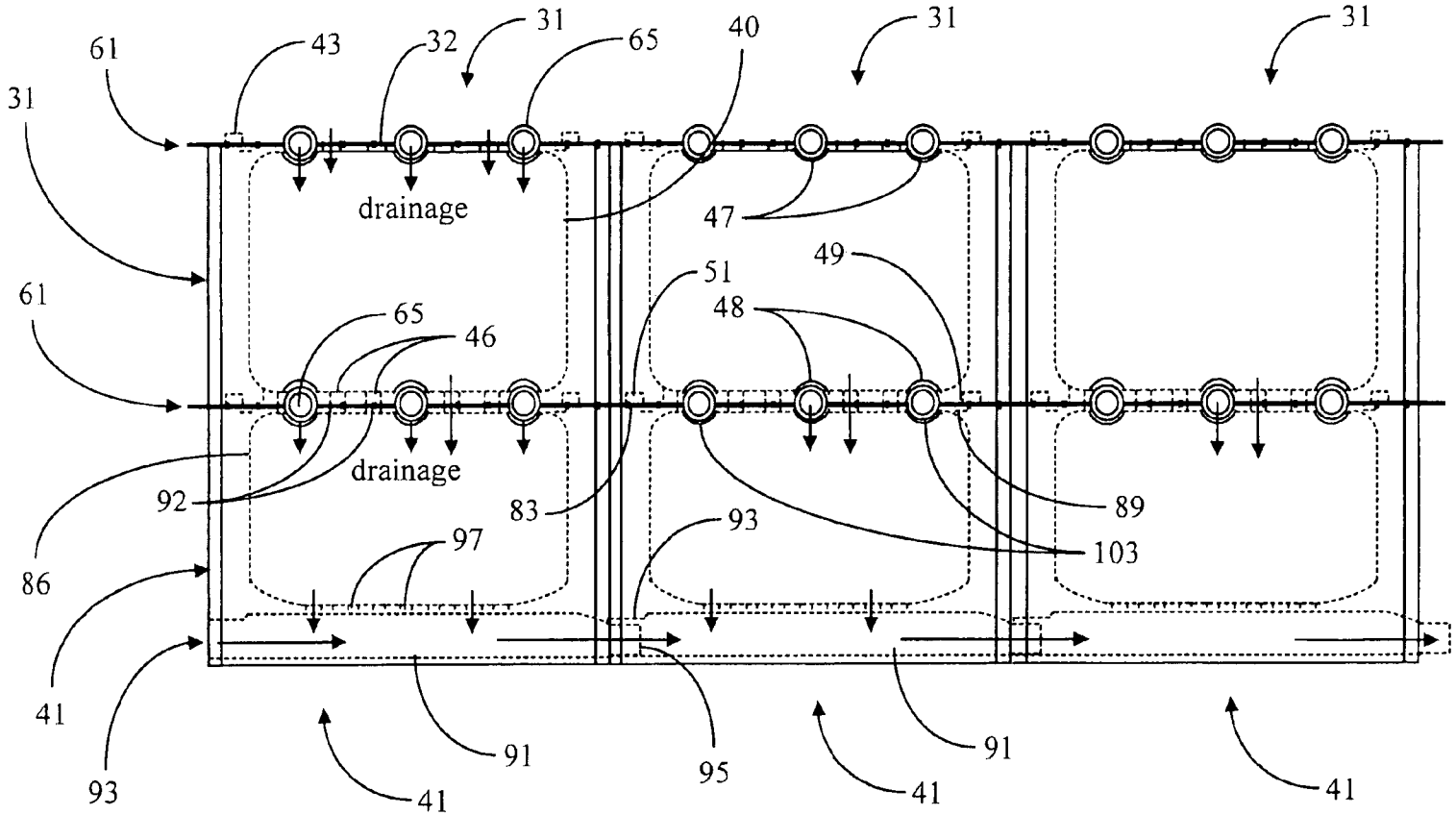
FIG. 6 is an elevation view the retaining wall blocks and drain grid of FIG. 4A and bottom-row retaining wall blocks of FIG. 5A assembled according to an embodiment of the present invention.

FIG. 6 is an elevation view of an assembly of retaining wall blocks 31 and drain grid 61 of FIG. 4A, and bottom-row retaining wall blocks 41 of FIG. 5A, assembled according to an embodiment of the present invention. The upper row, comprising three retaining wall blocks 31, has a drain grid 61 layered on top of the surfaces of blocks 31, and is attached by the header portion utilizing protrusions 43, the output ends of drain channels 65 securely seating within passages 47, as previously described for blocks 31. Three drainage blocks 41 form the lowermost row. Between the upper row of blocks 31 and the lower row of blocks 41, is another drain grid 61, which is attached to the upper surfaces of blocks 41, utilizing the protrusions similarly to that for the upper row of blocks 31. The output ends of channels 65 seat within drain passages 103 of blocks 41, also similarly as described for passages 47 of blocks 31, and drain into drain cavities 86 within blocks 41.

A shown in the illustration, each block 31 in the upper row is stacked upon a drainage block 41 in the lower row, the underside surface of blocks 31 substantially flush and in contact with the upper surfaces of blocks 41. Recesses 48 of blocks 31 seat securely over the output ends of drain channels 65 which are also securely seated within passages 103 of blocks 41. Blocks 31 are prevented from sliding back and forth or laterally by protrusions 49 of blocks 31 fitting snugly into recessions 89 of blocks 41, aided by extensions 83 of blocks 41 for securing mesh 63 of drain grid 61, also fitting snugly into recessions 51 of blocks 31, extending up into the bottom surface of blocks 31.

Drainage blocks 41 are the first and bottom row of blocks to be layered in construction of a drainage retaining wall in accordance with the present invention. A first block 41 is first positioned to begin the row, and a second block 41 is positioned next to the first block 41 such that the intake opening of drain conduit 91 of the second block 41 fits snugly over the output nozzle of drain conduit 91 of the first block 41. The second block 41 is then urged toward the first block 41 until the end of the second block 41 meets that of the first block, and a continuous drain conduit is thereby formed between drain conduit 91 of the first block and drain conduit 91 of the second block. A third block 41 is then positioned and urged against the other end of the second block, as in the second block 41 to the first block 41, thereby extending the retaining wall bottom layer, and also the drain conduit formed by conduits 91. The stepwise procedure is repeated for subsequent blocks 41 until the entire first bottom layer comprising blocks 41 is complete for the retaining wall being constructed. Once the first bottom row comprising blocks 41 is completed as described above, the drain grid 61 is attached by the header portion 67 (not shown) to the upper surface of blocks 41 as described above with drain channels 65 seating within passages 103 of blocks 41.

A second row comprising blocks 31 is then layered upon blocks 41, one block 31 at a time, utilizing the protrusions and extensions of blocks 31 and 41 as described above for aligning each upper block 31 to each lower block 41. Recessions 48 of blocks 31 in the upper row seat snugly over drain channels 65, and the bottom surface of each block 31 comes into substantial contact with the upper surface of each of 41, and is prevented from sliding in any direction, by way of the protrusions of one block fitting into the recessions of another, and drain grid 61 is securely anchored between the upper row of blocks 31 and the lower bottom row of blocks 41.

In the exemplary example shown in FIG. 6, water may drain into drain cavities 40 of blocks 31 from above through drain holes 32, drain channels 65 of drain grid 61, or through drain holes 53 of rear wall 36 (not shown). Water then drains from cavity 40 of block 31 out through the bottom of blocks 31 via drainage holes 46 of blocks 31, through drainage holes 92 extending through the upper surface of blocks 41, and into drain cavities 86 of blocks 41. Additional drainage may enter drain cavity 86 of block 41 via drain channels 65 of drain grid 61 secured between blocks 31 and 41, or also through drainage holes 101 (not shown) extending through the rear wall of blocks 41, as previously described. Water then drains from cavities 86 of blocks 41 down through drainage holes 97 at the bottom of drain cavity 86, and enters drain conduits 91, which then channel the water away.

Figure 7A:
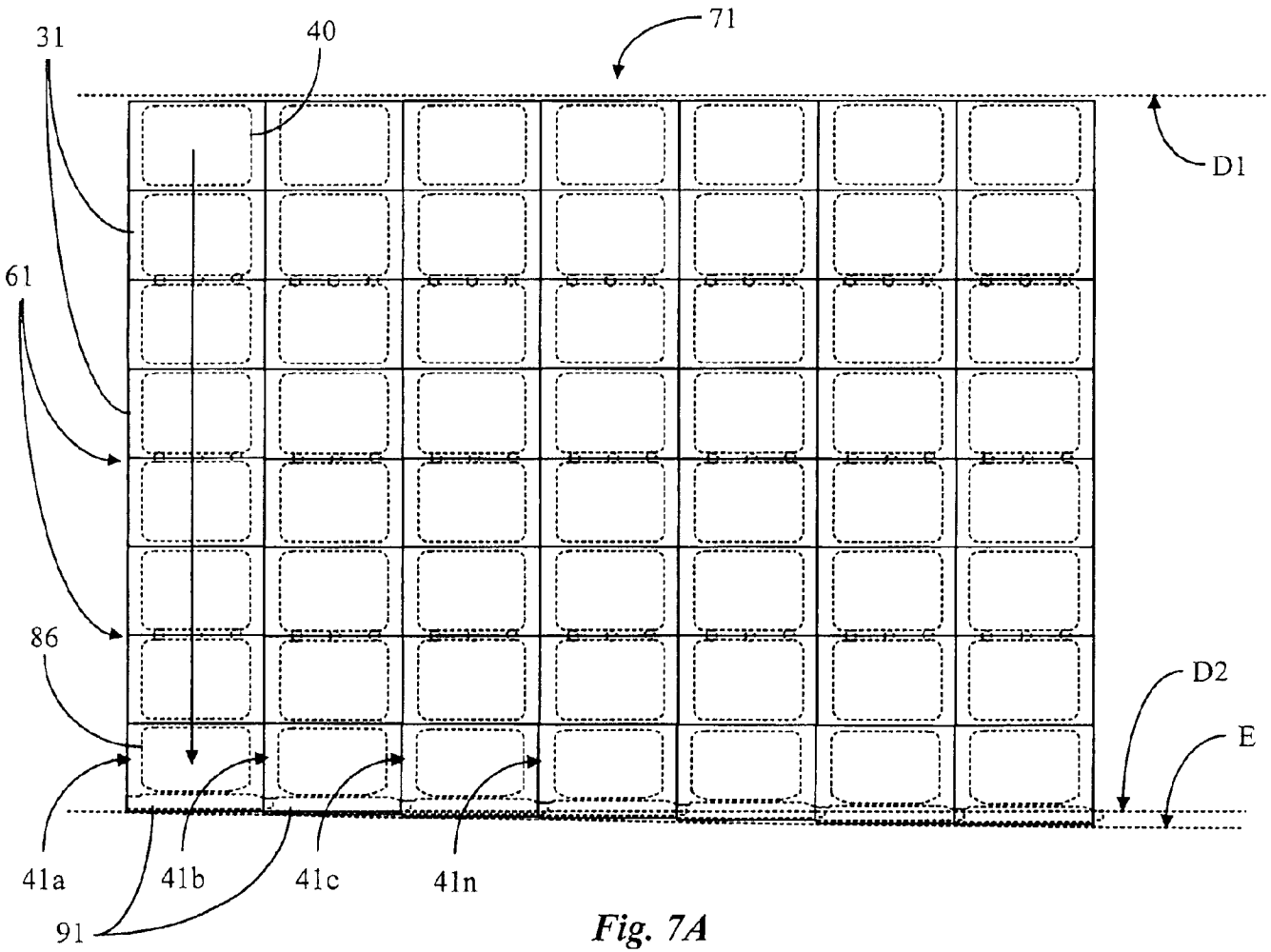
FIG. 7A is an elevation view of the retaining wall blocks and drain grid of FIG. 4A, and bottom-row retaining wall blocks of FIG. 5A forming a section of retaining wall according to an embodiment of the present invention.

FIG. 7A is an elevation view of retaining wall blocks 31 and drain grids 61 of FIG. 4A, and bottom-row drainage blocks 41 of FIG. 5A, forming a section of retaining wall according to an embodiment of the present invention. FIG. 7A is an example of a drainage-capable retaining wall constructed utilizing drain blocks 31, drain grids 61 and bottom-row drain blocks 41 in embodiments of the invention described above.

Retaining wall 71 as shown in the illustration comprises a first bottom row of drain blocks with an additional seven rows of blocks 31 layered upon the bottom row of drain blocks 41*a–n*. A section of drain grid 61 is layered upon the upper surface of the second row of retaining wall 71, which comprises blocks 31, and is secured between the upper surface of blocks 31 in the second row and the lower surface of the row of blocks 31 directly above in the third row. Additional sections of drain grid 61 are layered and secured between the surfaces of blocks in row 4 and 5, and again between rows 6 and 7, all of which comprise blocks 31. It is noted that the relevance of the intervals at which drain grids 61 are layered is not particularly important in describing the present invention as illustrated in FIG. 7A. In practice of the present invention, more, fewer or no layers of drain grid 61 may be utilized, depending on the drainage and anchoring requirements behind retaining wall 71. It is also noted that retaining wall 71 is an example only. In practice of the present invention there may be many more stacks of blocks 41 and 31, and each stack may comprise a much greater number of blocks 31, than are shown in the illustration.

As is well-known in the art, it is generally desirable to construct a retaining wall wherein, where practical, the upper surface of the top row of blocks utilized in the retaining wall is horizontally level. Line D1 represents a level line along which the upper surface of the top row of blocks 31 follows, in a preferred embodiment. It is also well-known that drain water which has drained to the bottom of the retaining wall from above, must be carried away from the retaining wall and be drained elsewhere, to avoid accumulation of drain water at the base of the retaining wall. A known preferable method for such disbursement is a gravity-fed flow of drainage water following a slight descending slope towards the drainage end of the retaining wall.

Such a gradual downward slope for carrying away is represented by line E, which begins at the bottom surface of the first lower drain block 41*a*, and follows a gradual downward slope along subsequent blocks 41*b*, 41*c*, and so on. Line D2 represents a horizontally level line parallel with top level line D1, beginning also at the bottom surface of the first lower drain block 41*a*.

In order to accommodate a gradual descent of the flow of drainage water passing through drain conduits 91 of blocks 41, blocks 41 are manufactured having slightly varying heights differing in small increments. In one example, if one wishes to build a retaining wall according to present invention, that is approximately 40 feet long, a total of 32 blocks 41 would be required in the first bottom row of the retaining wall. By knowing the standard rate of slope for a given number of feet of retaining wall for effectively dispersing drainage water, for example, a user may be able to provide the proposed length of the wall to the manufacturer of blocks 41, and the manufacturer may calculate the exact required size for each of the number of blocks 41 required for the project, beginning with a starting height of block 41*a*, as shown in FIG. 7A, for example, and incrementing the height of subsequent blocks 41 (41*b, c, d* and so on) such that the last block 41 in the row of 32 blocks is of the proper height such that, when all of the rows of blocks 31 are completed, the upper surface of the top row of blocks 31 is level, as represented by line D1.

Since all of the drainage conduits 91 in the bottom row of retaining blocks 41 must align with each other, in a preferred embodiment of the invention the small increments in height between one block 41 and another are increased above the level of drain conduit 91. For example the small increment in overall height may be incorporated into the upper cap wall 85 of block 41, resulting in a cap wall 85 having a slightly larger mean thickness than that of another block 41, or the additional increment in overall height may be achieved by adding height to the rear, side and face walls of block 41. It is noted that the method for incrementally increasing the height between one block 41 and another is not particularly important in describing the present invention, as long as each drain conduit 91 of each block 41, regardless of the differing overall heights of blocks 41, are elevated at the same distance from the bottom surface of each block 41, and all of drain conduits 91 are at the same level when all of the retaining blocks 41 are positioned side-by-side in forming the first bottom row of the retaining wall.

As shown in FIG. 7A, retaining wall 71 incorporates such a gradual downward slope in the bottom row of drain blocks 41, while all of the rows comprising blocks 31 are level with line D1. Drainage water may drain down from the top row of blocks 31 in the example shown, and drain down through subsequent rows of blocks 31, through drain cavities 40 and drainage passages in the top and bottom surfaces of blocks 31, as previously described, until reaching the lower row of drain blocks 41, at which point the drain water enters drain cavities 86 of blocks 41 through the drain holes in the upper surface of blocks 41. The water then drains from cavities 86 down through drainage holes into drain conduits 91, which carry the drain water away from retaining wall 71 along slope line E.

Figure 7B:
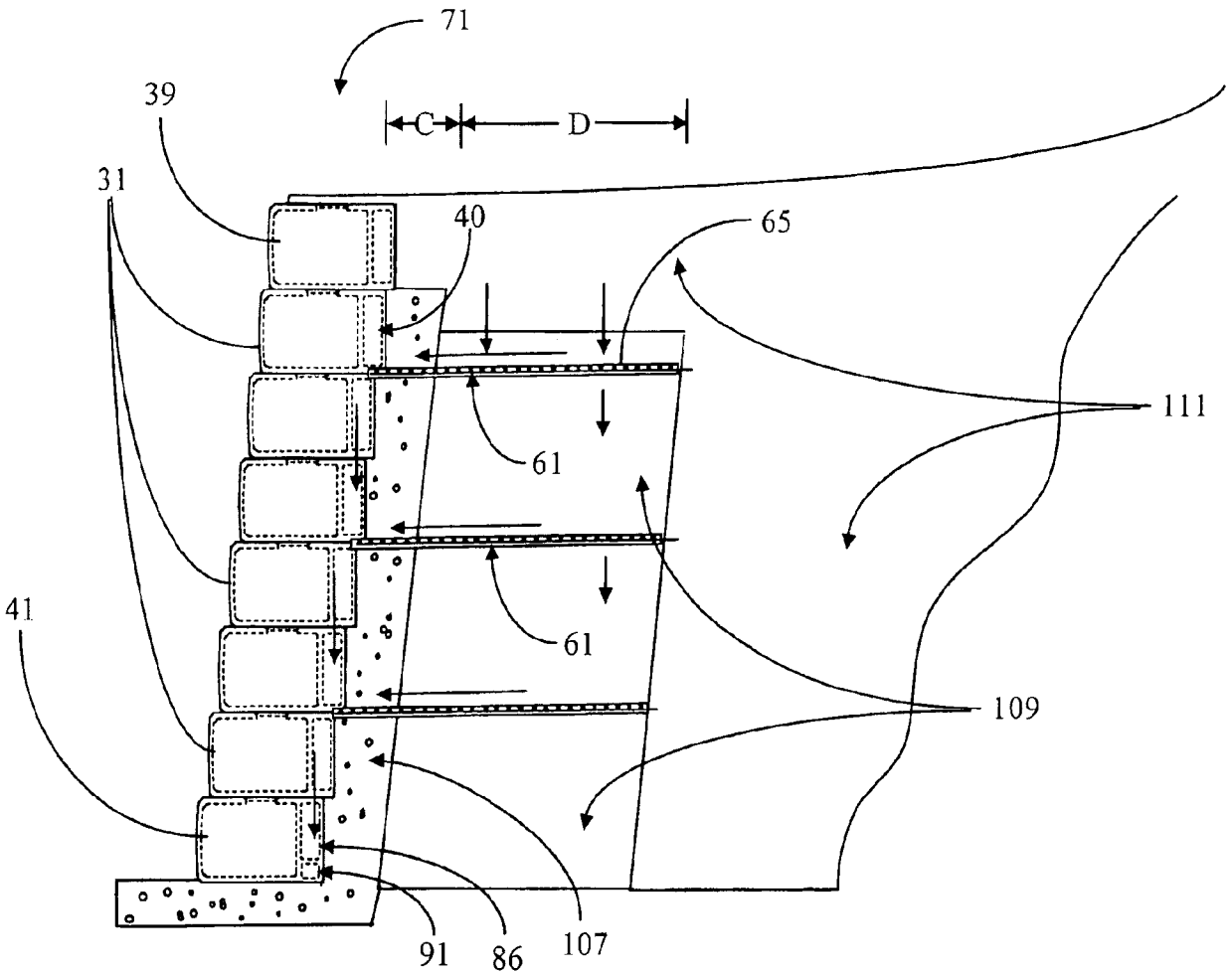
FIG. 7B is a side elevation view of the retaining wall and drain grids of FIG. 7A, retaining drain fill and back fill material and undisturbed soil according to an embodiment of the present invention.

FIG. 7B is a side elevation view of retaining wall 71 with drain grids 61 of FIG. 7A, retaining drain fill and back fill material and undisturbed soil according to an embodiment of the present invention. In this view retaining wall 71 is shown at a slight setback angle, as is commonly used for retaining walls over a certain height, or for retaining soil with certain conditions and so on, as described previously. A field of drain fill material 107, the field depth of which is represented by dimension C, extends directly behind retaining wall 71, and a field of free-draining back fill material 109, the field depth represented by dimension D, are utilized for drainage in the example illustrated, similar to those of retaining wall 14 of the prior art example of FIG. 1. However, in this example, by virtue of the substantial additional drainage capacity incorporated into blocks 31 and 41 of retaining wall 71, drain fill field depth C, and free-draining back fill field depth D are substantially shallower than drain field A and back fill field B of FIG. 1. A substantially smaller amount of drain fill 107 and back fill 109 is therefore required in construction of the retaining wall of the present invention, and, thus, a smaller excavation field is required prior to construction of the wall. It is noted that a drain pipe or "tile", as it is known, as shown in FIG. 1 for carrying away drainage water which accumulates through seepage towards the bottom and behind retaining wall 14, is also not required in a construction wall according to the present invention because the function of draining the lower drain flow and carrying the water away from the bottom of the retaining wall has been incorporated into drain conduits 91 of blocks 41 of the lower row.

Drain grids 61 are shown extending from in-between rows of blocks 31, and are attached to blocks 31 utilizing the mesh header portions 67 (not shown) of drain grids 61, as previously described with reference to FIG. 4A. Drain grid 61 extends behind retaining wall 71, at a slight upward angle, through the fields of drain fill 107 and back fill 109, generally extending entirely through the fields, and are securely anchored within the drain fill material by the weight of the compacted drain material itself, as well as the downward pressure from undisturbed soil 111 above. Retaining wall 71 is thereby securely anchored to the compacted fill material and soil behind retaining wall 71.

In the conventional system described with reference to FIG. 1, water drains through the undisturbed soil, and down through the drain fill and back fill material, passing unimpeded through the conventional geogrid mesh anchoring material 17, and finally down towards the bottom of the retaining wall towards a drain pipe system which carries the water away. In prior art, however, the water drain flow may exceed the drainage capacity of the drain and back fill materials, and the ability of a drain tile to carry the water away. In such an instance, particularly if the surrounding soil is previously saturated, the draining water will begin to accumulate in the fill material towards the bottom of retaining wall, and if the heavy drainage flows continue for a period of time at a rate exceeding the drainage capacity of the system, the water level will increase behind the retaining wall as the drain fill and back fill fields continue to fill with drainage overflow, because the upwardly accumulating water overflow exceeding the drainage capacity of the system, has nowhere else to accumulate but upward, because the water is prevented from passing through the rear surface created by the retaining wall, due to the water resistant or waterproof nature of the construction of the wall and conventional individual blocks utilized, and the undisturbed soil behind the drain fill and back fill fields may be saturated and unable to absorb additional drainage water. Accumulating drain water and an undue surcharge on the back of the retaining wall, and flooding or possible collapse of the system is the possible result in such an occurrence.

In the present invention, however, such accumulation of water drain flow behind the retaining wall is avoided because of the substantial additional drainage capability incorporated into the new and novel retaining wall building blocks as detailed above, and also the additional drainage capacity of drain grids 61, which reduces the amount of drainage water that would otherwise seep down through the drain fill and back fill fields through conventional geogrid material, to the bottom of the retaining wall.

Referring now again to FIG. 7B, drain grids 61, extending back into the fields of drain fill 107 and 109, capture a substantial amount of the drainage flowing down through the fields, and because of the slight angle incorporated into the placement of drain grids 61, sloping down towards the back of retaining wall 71, the drainage water captured by drain channels 65 of drain grid 61 is channeled away from the back fill and drainage fill fields towards the rear walls of individual blocks 31, wherein the water passes from drain channels 65 into drain cavities 40 of blocks 31 through the drain channel passages, as described previously, and is then drained down through the drain cavities 40 of successive blocks 31, until reaching the lower drain blocks 41, wherein the drainage water is carried away by drain conduits 91 of drain blocks 41. If a substantial and sustained rainfall occurs, such as described above, and the water drain flow temporarily exceeds the drainage capacity of the undisturbed soil and supplemental draining provided by drain fill 107 and back fill 109, any water that may begin to accumulate at the bottom of retaining wall 71 will drain into the perforated rear walls of blocks 41 and 31, into the internal drain cavities of the individual blocks, and will then drain down through the drain cavities of the blocks as described above. The accumulation of excess water drainage flow at the bottom of retaining wall 71, in such an instance, it is therefore largely prevented due to the increased drainage capability incorporated into the individual retaining wall blocks.

It will be apparent to one skilled in the art that many variations of the embodiments described above may be incorporated into the retaining wall blocks and drainage system described above, without departing from the scope and spirit of invention. For example, drain-capable retaining wall blocks 31 and 41 may be of a variety of different sizes, shapes and styles, and the internal fill cavities, drain cavities, and water passages for draining water into and out of the drain cavities may vary significantly in form from embodiments described herein, while retaining the unique drainage functionality incorporated. Furthermore, drain grid 61 may utilize a variety of different types and shapes of drain channels for channeling drain water from the drain fill and back fill fields. For example the drain channels incorporated into the drain grid mesh may be collapsible such that the drain grid with drain channels may be compactably stored and transported, and an upon unrolling and stretching out the drain grid, for example, the drain channels will expand enabling the water channeling functionality of the system.

Therefore, the present invention described above in terms of the preferred embodiments is defined only by the claims that follow, and not limited by the particular embodiments herein described in detail.

What is claimed is:

1. A drainage system comprising:

a wall structure comprising joined-together blocks forming a composite outside surface, each block having a set of liquid-impervious walls defining a completely bounded first cavity and a completely separate and bounded second cavity, the first cavity having a sealable fill opening for introducing a fill material to add weight, and the second cavity of individual blocks having a first opening for matching with first openings of adjacent blocks for passing liquid between blocks, and a plurality of second openings through the composite outside surface; and a drain grid comprising a planar mesh material having a width W and a length L, and a plurality of spaced-apart and parallel conduits for liquid, each conduit joined to the mesh material along a lower side and extending in the direction of the length L of the mesh material, and each conduit having a plurality of openings along an upper side opposite the lower side joined to the mesh, material;

wherein the conduits of the drain grid are spaced apart and sized to match in assembly with individual ones of the plurality of second openings through the composite outside surface, the conduits of the drain grid joined to the wall structure at the plurality of second openings, such that liquid entering the conduits may be conducted to the second cavities of the blocks forming the wall, and may be transferred between adjacent blocks through the first openings.

* * * * *